United States Patent [19]

Barlow

[11] Patent Number: 4,787,640

[45] Date of Patent: Nov. 29, 1988

[54] MECHANICALLY ACTUATED TURNTABLE TARGET GAME

[75] Inventor: Gordon A. Barlow, Highland Park, Ill.

[73] Assignee: Gordon Barlow Design, Skokie, Ill.

[21] Appl. No.: 124,152

[22] Filed: Nov. 23, 1987

[51] Int. Cl.[4] ..... A63F 9/02

[52] U.S. Cl. ..... 273/357; 273/368; 273/399

[58] Field of Search ..... 273/119 R, 119 A, 355, 273/356, 357, 368, 399

[56] References Cited

U.S. PATENT DOCUMENTS 4,253,669 3/1981 Ferris et al. ..... 273/357

4,371,171 2/1983 Silverman et al. ..... 273/357

FOREIGN PATENT DOCUMENTS 89395 11/1896 Fed. Rep. of Germany ... 273/119 R

*Primary Examiner*—Anton O. Oechsle

*Attorney, Agent, or Firm*—Kinzer, Plyer, Dorn, McEachran & Jambor

[57] ABSTRACT

A tabletop action game for two, three or four players in which each player attempts to be the first to dispose of a predetermined number of marbles by propelling the marbles into targets being carried on a rotating turntable, while also rotating the turntable. The game includes a generally square, plastic frame having a central opening. A frusto-conical shaped turntable is rotatably mounted in the central opening. A lever operated mechanism for rotating the turntable is located at each corner of the frame. Also provided at each corner of the frame, adjacent the lever operated rotating mechanism, is a lever operated marble propelling mechanism. A chute is installed over each marble propelling mechanism to direct the propelled marbles onto the turntable. The targets includes a open top replica of a garbage truck and an open top replica of a trash container.

8 Claims, 2 Drawing Sheets

Fig. 1.
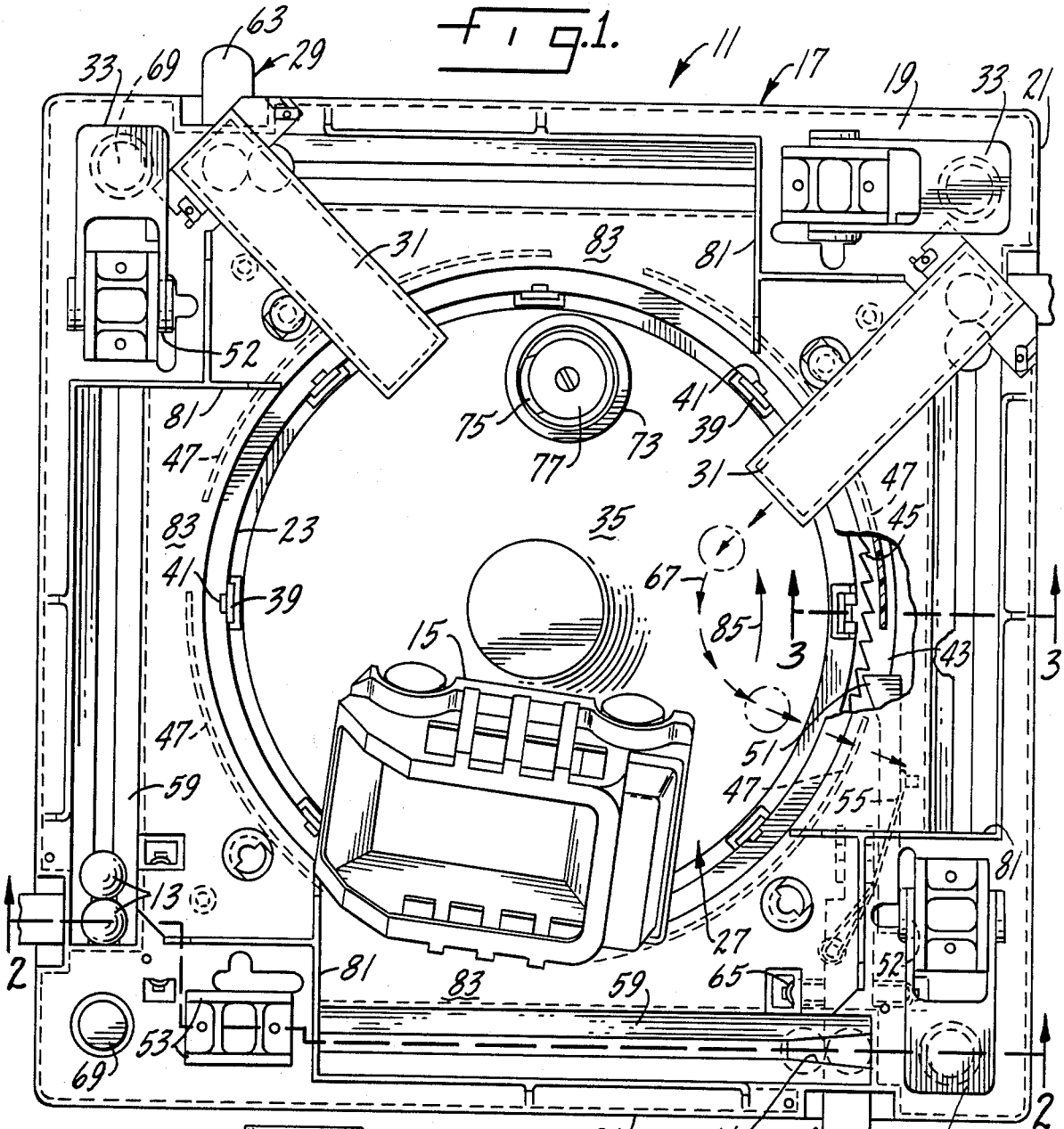
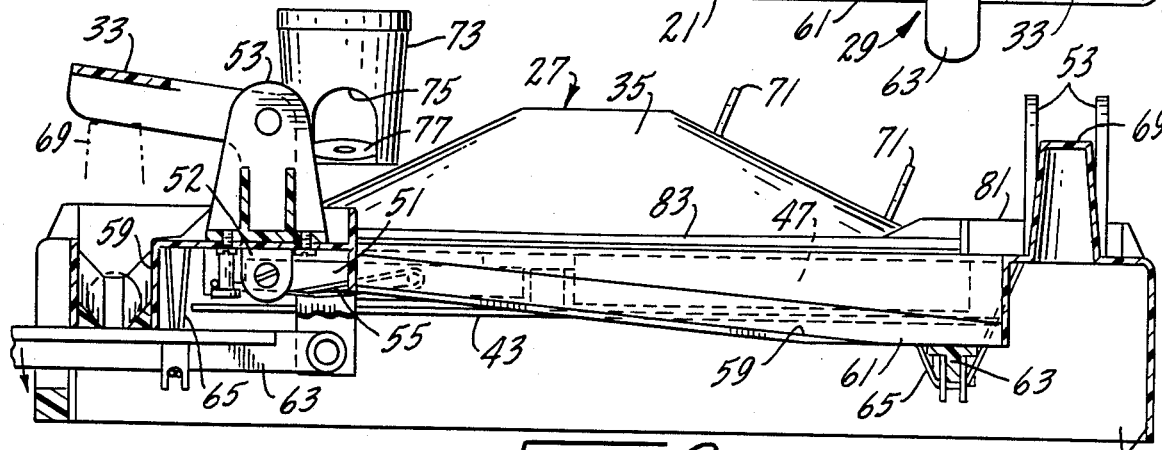
Fig. 2.

MECHANICALLY ACTUATED TURNTABLE TARGET GAME

BACKGROUND AND SUMMARY OF THE INVENTION

This invention is directed to a tabletop action game which may be utilized by two, three or four players and which challenges the dexterity, coordination and skill of the players. The invention is particularly directed to a tabletop action game in which each player attempts to dispose of a predetermined number of marbles by propelling the marbles into a rotating target, while also contributing to the rotation of the target.

An object of this invention is a game requiring coordination of both hands by a player to rotate the target carrying turntable with one hand, while properly timing the actuation of the marble propelling means with the player's other hand to shoot the marbles into selected target containers on the rotating turntable.

Another object of this invention is a tabletop action game in which the target carrying turntable is actuated mechanically by the players and is not dependent on a source of electrical power, such as batteries.

Another object of this invention is a tabletop action game in which marbles that are propelled into a collection container in the shape of a trash basket are automatically recirculated, and the marbles that are collected in the container resembling a garbage truck will be recirculated upon tilting of the garbage truck.

Another object of this invention is a tabletop action game in which the winner is the first player to properly dispose of his marbles and, thus, the more skilled players can be handicapped by allotting them more marbles at the start of the game.

Other objects and purposes of this invention will become apparent from a reading of the following specification, claims and drawings.

BRIEF DESCRIPTION OF THE DRAWINGS

The invention is illustrated more or less diagrammatically in the following drawings wherein:

FIG. 1 is a top plan view of a preferred embodiment of the tabletop action game of this invention, with some parts omitted for clarity of illustration, and the path of travel of a typical marble propelled onto the turntable shown by arrows in sequential positions of the marble as it travels, which positions are shown in phantom lines;

FIG. 2 is a cross-sectional view, taken along line 2—2 of FIG. 1, with the turntable rotated 90 degrees from the position shown in FIG. 1, and some parts omitted for clarity of illustration;

DESCRIPTION OF THE PREFERRED EMBODIMENT

Figure 3:
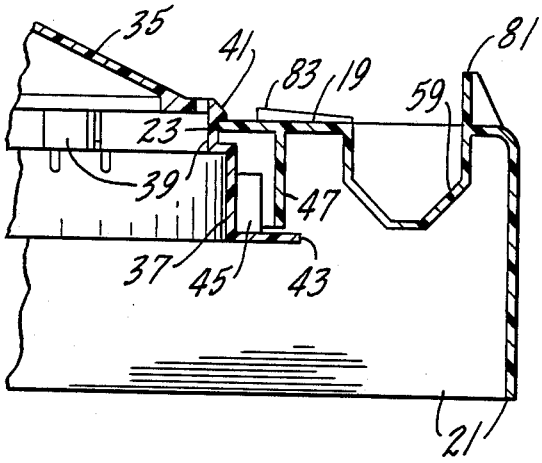
FIG. 3 is an enlarged cross-sectional view, taken along line 3—3 of FIG. 1, with parts omitted for clarity of illustration.
Figure 4:
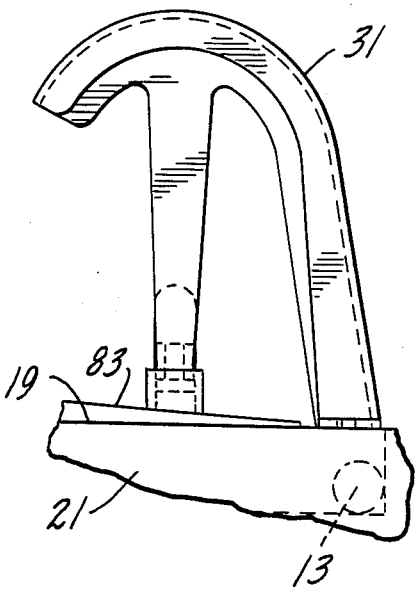
FIG. 4 is a partial side elevational view of a marble discharge chute of this invention.

FIG. 1 of the drawings shows a table game 11 intended for use by two to four players, each of whom tries to be the first to dispose of his "garbage", which is in the form of marbles 13, by either disposing of them in a replica of a garbage truck 15 or diverting them to his fellow players. The game includes a hollow plastic, thin-walled housing 17 having a top surface 19 supported by side walls 21. A centrally located circular opening 23 is located in the top surface 19.

A turntable 27 is rotatably mounted in the central circular opening 23. Located at each of the four corners of the housing 17 are a marble propelling or shooting mechanism 29, each with a curved plastic chute 31 to direct the marbles which have been shot onto the turntable 27, and a hand operated, depressible lever 33 which is a part of a mechanism for rotating the turntable.

The turntable has a frusto-conical top 35 supported on an annular ring 37, as can be most clearly seen in cross section in FIG. 3 of the drawings Positioned around the outer periphery at the upper end of the ring, and equally spaced around the periphery thereof, are upstanding fingers 39 having detents 41 which snap over the top surface 19 of the housing 17 to support the turntable on the plastic housing for rotation A radially-extending rim 43 is formed on the lower edge of the annular ring, and a plurality of ratchet teeth 45 are also formed on the outer surface of the ring, above the rim 43. The rim 43 extends below an interrupted annular, downwardly-depending wall 47 projecting downwardly from the underside of the top surface 19 of the housing to prevent the turntable from falling out of the central circular opening 23 in the event the housing is accidentally inverted.

The turntable 27 is rotated by each player depressing his lever 33 of his turntable rotating mechanism. As part of this mechanism, a slidable ratchet bar 51 is pivotally connected to the lower end of one L-shaped side 52 of the depressible lever 33, which is pivotally mounted on a pair of spaced apart uprights 53 so that depression of the lever slides the ratchet bar into engagement with the ratchet teeth 45 of the turntable to rotate the turntable in a counterclockwise direction, as viewed in FIG. 1 of the drawings. A tensioned rubber band 55 is provided to return the ratchet bar to its disengaged position relative to the ratchet teeth 45. During this reciprocal motion, the ratchet bar is supported at its teeth-engaging end on the rim 43 of the annular turntable ring 37, as shown in FIG. 3 of the drawings.

An inclined trough 59 is formed in the top surface 19 of the housing 17 adjacent each side wall 21 of the housing 17, with each trough sloping toward its respective marble shooting mechanism 29. An opening 61 is formed in the lowest end of each trough, just above the marble shooting mechanism, and is sized so that a portion of the marble 13 will extend downwardly through the opening below the trough. Located below the opening 61 is a finger operated, pivotally mounted lever 63 which is biased by a rubber band 65 into contact with a portion of a marble extending through the opening 61 in the trough 59. When the lever is pushed to its lowest position and released, the resilience of the rubber band 65 will bring it sharply into contact with a marble, a portion of which is extending through the opening 61 at the end of the inclined trough to propel the marble upwardly. Located above the opening 61 in the trough is a downwardly opening, curved, clear plastic chute 31 which directs the propelled marble onto the turntable 27 in the manner shown by the arrows 67 in FIG. 1 of the drawings A frusto-conical shaped upstanding stop 69 is provided under each depressible lever 33 to limit downward movement of this lever.

The replica of the garbage truck 15 is in the form of a plastic structure having front, side and end walls, an open bottom and an open top. It is positioned on the conical portion of the frusto-conical top 35 of the turntable so that as it moves around with the turntable, at times its open top will be in alignment with the outlet of one of the curved plastic chutes 31, which are provided for each player. The plastic structure forming the replica of the garbage truck is pivotally attached to brackets 71 mounted on the turntable conical top using an axle of the garbage truck so that it can be emptied of its collected marbles simply by raising the back end of the truck. Also located on the turntable, and, in this example, 180 degrees away from the garbage truck structure 15, is a waste basket 73. The waste basket has an opening 75 in one side facing in the direction of rotation of the turntable and an inclined bottom 77 so that any marble shot into the waste basket by a player will be discharged into the player's opponent downstream of the direction of rotation of the turntable. Walls 81 are provided extending from the turntable to the troughs to direct the recirculated marbles into the troughs. Inclined surfaces 83 are positioned on the top surface 19 of the housing 17 between the turntable and the troughs to insure that the marbles rolling off the turntable roll into the troughs.

The use, operation and function of this invention are as follows. The table game 11 of this invention can be played by two, three or four players who contribute to the rotation of the turntable and also shoot marbles at the two containers carried on the turntable, with the object of the game being to dispose of the marbles before any other player disposes of his marbles. A player can dispose of the marbles by depositing them in the garbage truck 15 or, if an opponent is getting ahead of him in disposing of his marbles, to divert one of the player's marbles to his opponent by depositing it in the trash basket 73 where it will roll to the trough of the downstream player. The chutes and turntable are arranged so that if a player misses the garbage truck or trash basket, his marbles will usually return to his own trough and be automatically returned to his propelling mechanism. This is accomplished by pointing the discharges of the chutes against the direction of rotation of the turntable, which is shown by the arrow 85 in FIG. 1. The trash basket will discharge a properly deposited marble in the direction of rotation of the turntable, thereby carrying it on to the next player downstream from the player who shot the marble into the trash basket.

As the tempo of the game increases, the players can speed up rotation of the turntable by more rapidly depressing the turntable rotation levers. It should be appreciated that the input of the players is cumulative so the turntable will turn much more faster as the tempo of the game increases. The higher speed of the turntable also makes the depositing of the marbles in the garbage truck or trash basket much more difficult, and thereby also increases the excitement of the game.

Whereas the preferred form of the invention has been shown and described herein, it should be realized that there may be many modifications, substitutions and alterations thereto.

I claim:

1. A tabletop action game including:

a generally square frame having a central opening, a turntable mounted in the central opening for rotation relative to the frame, means located at each corner of the frame to rotate the turntable in one direction, means located at each corner of the frame adjacent to the turntable rotating means to propel marbles onto the turntable, a first container means mounted on the turntable for receiving properly directed, propelled marbles and retaining them, and means formed as parts of the turntable and frame for returning the propelled marbles that are not received and retained by the first container means to the corner propelling means that propel them.

2. The tabletop action game of claim 1 further including:

a second container means mounted on the turntable for receiving properly directed marbles and returning them to a corner propelling means other than the corner propelling means that originally sent them to the second container.

3. The tabletop action game of claim 2 further characterized in that:

said second container means includes a structure having a continuous side wall and an open top with an opening in the continuous side wall facing in the direction of rotation of the turntable and an inclined bottom n the container sloping in the direction of said opening.

4. The tabletop action game of claim 1 further characterized in that:

said means located at each corner of the frame to rotate the turntable in one direction includes ratchet teeth on the turntable, a longitudinally slidable ratchet bar movable into and out of engagement with said ratchet teeth, a pivotally mounted, L-shaped lever attached to the longitudinally slidable ratchet bar to move the ratchet bar into rotational engagement with the turntable ratchet teeth upon rotation of said L-shaped lever, and resilient means to return said ratchet bar to its disengaged position relative to said ratchet teeth.

5. The table top action game of claim 1 further characterized in that:

said means located at each corner of the frame to propel marbles onto the turntable includes a holder for a marble having an open top, a bottom in the holder having an opening proportioned so that a portion of the marble extends below the bottom, a pivotally mounted lever located below the marble holder opening and positioned to engage a portion of the marble extending below the bottom of the marble holder, a resilient means to bias the lever against a marble held in the holder, and a downwardly opening chute mounted over the pivotally mounted lever to direct a propelled marble onto the turntable.

6. The game of claim 5 further characterized in that:

each chute directs the propelled marbles onto the rotating turntable against the rotation of the turntable.

7. The game of claim 1 further characterized in that:

said first container means includes a structure having side, front and rear end walls in the shape of a garbage truck, an open top and an open bottom for said structure, with one end wall of the structure pivotally attached to the turntable to permit raising the structure to release any marbles collected therein.

8. The tabletop action game of claim 1 further characterized in that:

said means formed as parts of the turntable and frame which return the propelled marbles that are not received and retained by the first container means to the corner propelling means that propel them includes conical walls formed on the turntable and sloping in the direction of the frame, and a trough for receiving and guiding the marbles to their corner propelling means located adjacent the conical walls of the turntable, with each trough inclined in the direction of its marble propelling means.

* * * * *